United States Patent [19]

Safai

[11] Patent Number: 4,494,305

[45] Date of Patent: Jan. 22, 1985

[54] CONTACT EXTRACTION TOOL

[75] Inventor: Sohrab Safai, Irvine, Calif.

[73] Assignee: International Telephone & Telegraph Corporation, New York, N.Y.

[21] Appl. No.: 444,644

[22] Filed: Nov. 26, 1982

[51] Int. Cl.[3] ..... H01R 43/00

[52] U.S. Cl. ..... 29/764; 29/758

[58] Field of Search ..... 29/739, 747, 764, 758

[56] References Cited

U.S. PATENT DOCUMENTS

| | | | |
|---|---|---|---|
| 3,380,141 | 4/1968 | Rofer | 29/764 |
| 3,587,159 | 6/1971 | Dunkow | 29/764 |
| 4,168,569 | 9/1979 | Fairbairn | 29/764 |

*Primary Examiner*—Carl E. Hall

*Attorney, Agent, or Firm*—T. L. Peterson

[57] ABSTRACT

A contact extraction tool in which a pair of spring arms may be squeezed together to force jaws on the ends of the arms inwardly through holes in the tip of the tool to firmly grip a contact therein while the tip is releasing contact retention element in a connector assembly to facilitate withdrawal of the contact from the assembly.

9 Claims, 8 Drawing Figures

CONTACT EXTRACTION TOOL

BACKGROUND OF THE INVENTION

The present invention relates generally to a connector and, more particularly, to a unique tool for removing contacts from a connector body.

While the present invention will be described specifically in connection with a tool for removing contacts from an electrical connector, it will be appreciated that the tool could also be utilized for removing ferrules from fiber optic connectors.

In U.S. Pat. No. 3,110,093 to Johnson, there is disclosed an electrical connector of the type wherein one or more contacts, each connected to a wire, are inserted from the rear into a contact receiving bore in a connector body or insulator after the connector has been otherwise completely fabricated or assembled. The insulator includes a retaining clip or other locking means between the individual contacts and their respective bore walls for retaining the contacts in their operative position in the insulator. The Johnson patent also discloses a suitable tool for insertion into clearance space between the contact and the bore wall from the rear of the insulator to disengage the locking device and thereby permit manual withdrawal of the contact from the rear of the insulator by pulling on the wire attached to the contact. While this arrangement works well when a wire is present, the tool is ineffective fr an unwired contact in that the wire receiving portion of the contact normally does not extend beyond the rear of the insulator to permit the contact to be gripped for withdrawal.

U.S. Pat. No. 3,380,141 Rofer discloses a tool for removing an unwired contact which, when inserted into the contact bore from the rear of the insulator, releases the locking means therein and frictionally engages the rear of the contact so that it may be withdrawn from the bore.

French Pat. No. 2,240,600 discloses a front release contact retention assembly, in contrast to the rear release arrangments disclosed in the aforementioned Johnson and Rofer patents, wherein a contact extraction tool is inserted through the contact bore from the front of the insulator to release the contact locking means therein. The tip of the tool is longitudinally slotted and dimensioned so that it will frictionally engage the contact. Thus, as in the Rofer arrangement, the contact locking means is released while the tool frictionally engages the contact, thereby allowing the contact to be removed from the insulator. If manufacturing tolerances are not closely held in the forming of the prior art tools, it will be appreciated that adequate frictional engagement of the tool with the contact may not occur with the result that the tip of the tool may slip off the contact when the tip is withdrawn from the contact bore. Furthermore, even if the tool initially frictionally engages the contact with adequate force to allow the contact to be withdrawn from the insulator, continued use of the tool can result in the tip of the tool wearing so that it no longer firmly engages the contact.

It is the object of the present invention to provide a contact extraction tool which embodies manually operable gripping jaws which will assure that a firm gripping force can be applied to the contact so that the contact will be pulled out of the insulator when the tip of the tool is withdrawn from the contact bore.

SUMMARY OF THE INVENTION

According to a principal aspect of the present invention, there is provided a contact extraction tool of the type referred to above comprising a handle and a forward portion having a tip section which is adapted to be inserted into the contact bore in a connector insulator over the contact to release a contact retention finger or similar locking device which normally retains the contact in the bore. Contact gripping means is provided comprising a manually actuating section which is located behind the tip section of the tool and a forward jaw movable laterally toward one side of the forward portion of the tool to firmly grip the contact therebetween when the actuating section is engaged by an operator and while the tip section is releasing the contact retention device. Preferably, the contact gripping means comprises a pair of spring arms on opposite sides of the handle of the tool which may be readily squeezed by the operator to cause the jaws on the ends of the arm to move inwardly toward each other to firmly grip the contact therebetween. Thus, the tool of the present invention does not rely upon sliding frictional engagement as in the tools disclosed in the aforementioned Johnson and French patents, but rather it allows positive direct force to be applied by the operator to the contact to the degree required to pull the contact out of the insulator.

DESCRIPTION OF THE PREFERRED EMBODIMENTS

Figure 1:
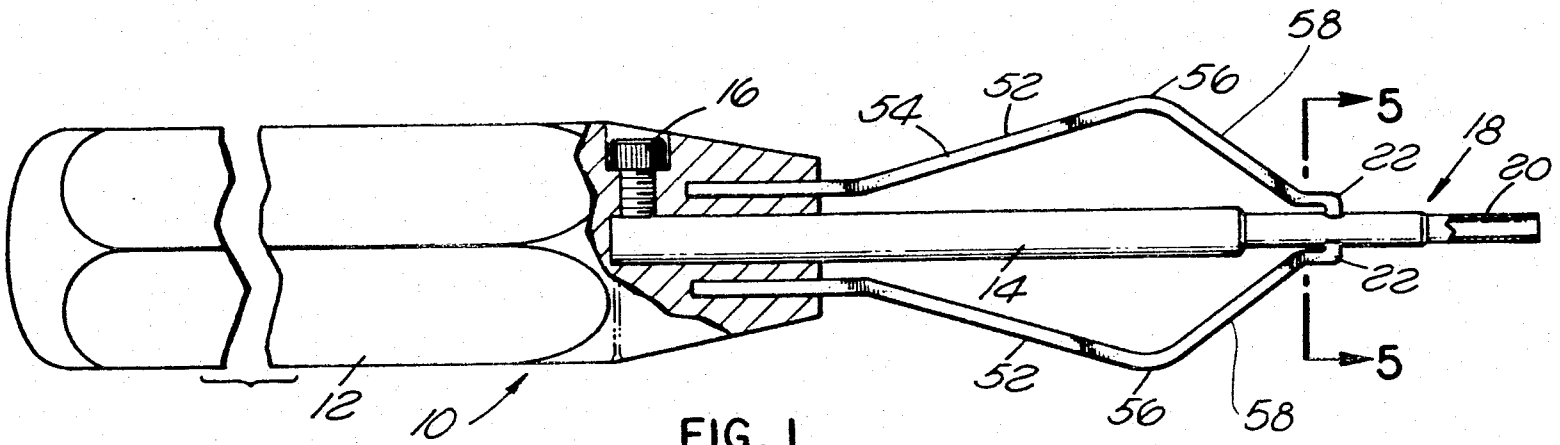
FIG. 1 is a side elevational view of the tool of the present invention shown partially in section.

Referring to FIG. 1, the tool of the present invention, generally designated 10, comprises a handle 12 and a forwardly extending rod 14 which is fixed in the handle by a set screw 16. A forward hollow portion 18 of the rod has a tubular tip section 20 thereon which is utilized to release the locking device for the contacts in the connector assembly, and the contact gripping jaws 22.

Figure 8:
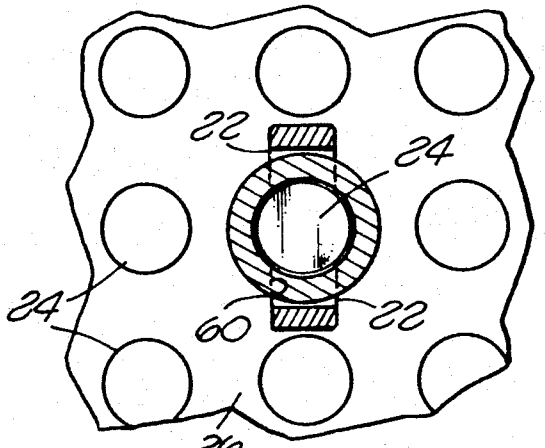
FIG. 8 is a transverse sectional view taken along line 8—8 of FIG. 7 showing how the forward portion of the tool fits between the contacts in the connector assembly.
Figure 6:
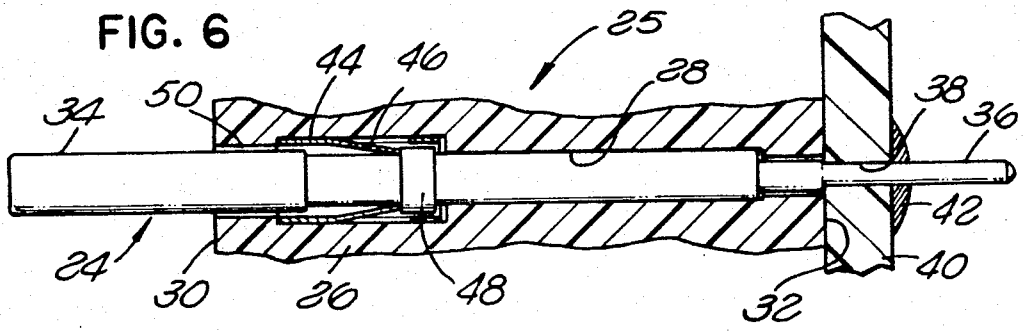
FIG. 6 is a partial vertical sectional view through a connector assembly with which the tool of the present invention may be utilized.
Figure 7:
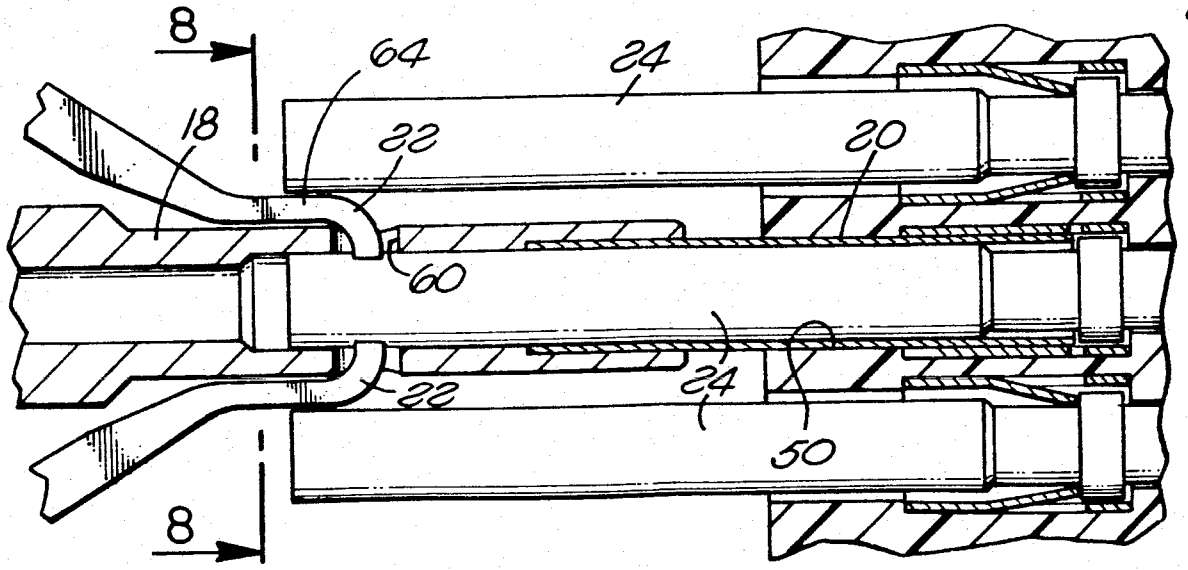
FIG. 7 is an enlarged, partial sectional view showing the forward end portion of the tool inserted into the contact cavity of a connector assembly as illustrated in FIG. 6, with a plurality of contacts being shown in the assembly.

The tool 10 is particularly suited for removing contacts 24 from the connector assembly 25 illustrated in FIGS. 6 to 8. The connector assembly comprises an insulator 26 containing a plurality of contacts, as seen in FIGS. 7 and 8, only one of such contacts being shown in FIG. 6. Each contact 24 is mounted in a bore 28 which extends from the front face 30 to the rear 32 of the insulator 26. The contact 24 is shown as being a socket contact, although it could be a pin contact if desired. The contact embodies a forward hollow cylindrical mating section 34 and a rearwardly extending tail 36 which extends through a plated through hole 38 in a printed circuit board 40 mounted behind the insulator 26. Solder 42 may be utilized to electrically connect the tail to the plated through hole.

A contact retention clip 44 is mounted in the forward portion of the bore 28. The clip embodies a pair of inwardly and rearwardly extending resilient retention fingers 46 which bear against an enlargement 48 on the contact body to restrict forward movement of the contact in the bore 28.

Figure 4:
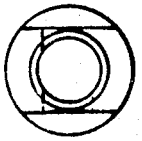
FIG. 4 is a front end view of the forward portion of the tool.
Figure 2:
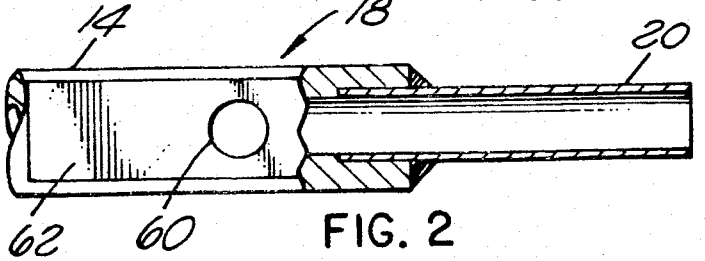
FIG. 2 is an enlarged partial sectional view of the forward portion of the tool illustrated in FIG. 1.
Figure 3:
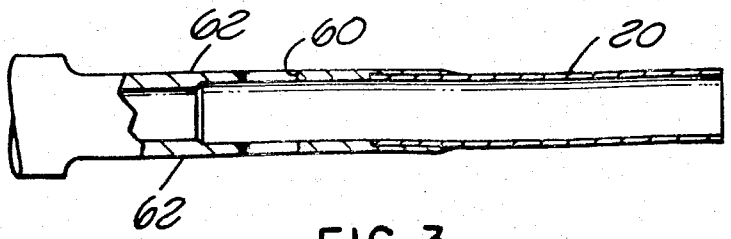
FIG. 3 is a partial sectional view similar to FIG. 2 but showing the forward portion of the tool rotated 90°.

Referring now to FIGS. 2 to 4, it is seen that the tip section 20 of the tool comprises a thin walled tube which is secured within the hollow end section 18 of the rod 14. The tip section of the tool is dimensioned to slide over the forward end of the contact 24 through the narrow annular clearance space 50 between the contact and the wall of the bore 46 at the forward end of the insulator so that the tip may be slid under the retention fingers 46 to expand them outwardly out of engagement with the enlargement 48 on the contact as best seen in FIG. 7 whereby the contact will be released and thus free for forward extraction from the insulator 26.

Figure 5:
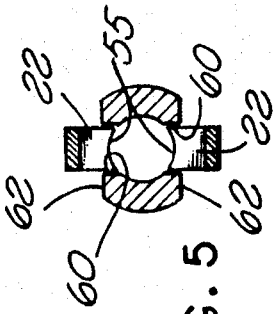
FIG. 5 is a transverse sectional view taken along line 5–5 of FIG. 1 showing the contact engaging jaws of the tool.

The contact gripping means of the tool 10 comprises a pair of spring arms 52 each embedded at its rear in the body of the handle 12. The arms are mounted on opposite sides of the rod 14 and extend lengthwise of the rod generally aligned with the center axis of the tip section 20 of the tool. The arms 52 are bowed outwardly in opposite directions providing rear outwardly diverging sections 54, intermediate reversely bent sections 56 and forward inwardly converging sections 58. The forward ends of the arms 52 are bent inwardly to form the jaws 22. Preferably, the inner surfaces 55 of the jaws have an arcuate configuration conforming to the outer surface of the forward mating section 34 of the contact 24 as best seen in FIG. 5. The surfaces 55 of the jaws may be roughened or serrated to enhance the frictional engagement of the jaws with the contact. The jaws extend inwardly through holes 60 formed in opposite sides of the hollow section 18 of the tool behind the tip section 20.

When it is desired to remove the contact 24 from the bore 28 in the connector assembly, the tip section 20 of the tool is inserted into the forward end of the bore over the contact, as seen in FIG. 7, releasing the retention fingers 46 as mentioned previously. While the fingers are released, the operator may actuate the spring arms 52 by squeezing them in the intermediate outwardly bowed regions 56 thereby forcing the jaws 22 inwardly to firmly engage the end of the contact so that the operator may then pull the contact out of the insulator. The operator may apply as much force as required to the spring arms to grip the contact to assure that it will be withdrawn from the insulator. When the spring arms are released, the inner surfaces 55 of the jaws 22 are normally located outside the interior of the hollow section 48 of the tool so as not to interfere in insertion of the forward portion of the tool over the contact.

As best seen in FIG. 8, frequently contacts in connector insulators are positioned very close to each other leaving very little room for an extraction tool to be inserted over a contact for removal. In order to reduce the cross section of the forward end portion of the tool so that it may be utilized with a high density arrangement of contacts, in accordance with another feature of the invention the opposite sides of the hollow section 48 of the tool which contain the holes 60 are formed flat, such as by machining, to provide parallel flat surfaces 62, as best seen in FIGS. 3 and 5. As seen in FIG. 7, the forward sections 64 of the spring arms immediately behind the jaws 22 are parallel to each other and closely positioned adjacent to the flat surfaces 62. By cutting away portions of the hollow section 48 of the tool to form the flat surfaces 62, and bending the spring arms flat at 64 in a manner just described, the cross section of the tool in the region of the tool where it is inserted between the contacts is reduced to a minimum so that the tool may be used with a connector having a high density of contacts, yet a positive gripping force may still be applied to the contact by actuating the spring arms in the regions 56 behind the forward portion of the tool which is inserted between the contacts.

While the tool of the present invention has been described in connection with a front insert, front release contact retention arrangement, it will be appreciated that the tool could also be utilized for extracting contacts from the rear of an insulator in a rear release, rear contact withdrawal arrangement, in those cases when the contacts are not connected to wires to facilitate pulling of the contacts out of the insulator. However, in such case the parallel sections 64 of the spring arms would have to be extended because the rear of the contacts do not extend behind the rear of the insulator. Further, while the tool has been described as embodying a pair of spring gripping arms 52, it will be appreciated that the tool could also be operated with only a single spring arm so that the contact will be gripped between one jaw and the opposite surface of the interior wall of the hollow section 48 of the tool.

What is claimed is:

1. A contact extraction tool for use in a connector with a contact that is releasably lockable in a bore within a connector body by a resilient retention element extending between the wall of said bore and said contact, said tool comprising:

a handle and a forward portion having a tubular tip section to be inserted into said bore over said contact to release said retention element from its locking position, said forward portion including a hollow section behind said tip section;

an opening in the wall of said hollow section; and contact gripping means having a manual actuating section outside of said forward portion between said handle and said hollow section, said gripping means having a forward jaw movable laterally through said opening toward one side of said hollow section to firmly grip the contact therebetween when said actuating section is engaged by an operator and while the tip section is releasing said retention element.

2. A tool as set forth in claim 1 wherein:

two of said openings are provided in the wall of said hollow section opposite from each other;

said gripping means includes a pair of said actuating sections each having a jaw associated therewith; and said actuating sections being on generally opposite sides of said forward portion to be squeezed together by the operator to cause said jaws to move toward each other through said openings to grip the contact therebetween.

3. A tool as set forth in claim 2 wherein:

said hollow section has an outer diameter greater than that of said tip section and opposed flat surfaces in which said openings are formed, the distance between said flat surfaces being less than the outer diameter of said hollow section.

4. A tool as set forth in claim 2 wherein:

said gripping means comprises a pair of resilient elongated arms extending lengthwise of the axis of said tip section; and an intermediate region of said arms form said actuating sections and the forward ends of said arms are bent inwardly toward each other to provide said jaws.

5. A tool as set forth in claim 4 wherein:

said arms diverge outwardly from said handle to said intermediate regions and are reversely bent at said regions so as to converge inwardly toward said forward portion.

6. A contact extraction tool for use in a connector with a contact that is releasably lockable in a bore within a connector body by a resilient retention element extending between the wall of said bore and said contact, said tool comprising:

a handle and a forward portion including a cylindrical hollow section and a tubular tip section in front of said hollow section;

said tubular tip section having a smaller outer diameter than that of said hollow section, said tip section to be inserted into said bore to slide over said contact to release said retention element from its locking position;

a pair of flat surfaces formed in opposite sides of said hollow section;

an opening extending through said hollow section at one of said flat surfaces; and contact gripping means having a manual actuating section outside of said forward portion and behind said tip section and a forward jaw movable laterally through said opening toward one side of said hollow section to firmly grip the contact therebetween when said actuating section is engaged by an operator and while the tip section is releasing said retention element.

7. A tool as set forth in claim 6 wherein:

said hollow section embodies openings extending therethrough at each of said flat surfaces;

said gripping means includes a pair of said actuating sections on generally opposite sides of said forward portion adjacent to said flat surfaces each having a jaw associated therewith extending through one of said openings; and said actuating sections to be squeezed together by the operator to cause said jaws to move toward each other to grip the contact therebetween.

8. A tool as set forth in claim 7 wherein:

said gripping means comprises a pair of resilient, outwardly bowed arms extending lengthwise of the axis of said tip section.

9. A tool as set forth in claim 8 wherein:

the forward ends of said arms are bent inwardly toward each other to provide said jaws.

* * * * *